United States Patent [19]

Yanai et al.

[11] Patent Number: 4,793,141

[45] Date of Patent: Dec. 27, 1988

[54] GLAND SEALING STEAM SUPPLY SYSTEM FOR STEAM TURBINES

[75] Inventors: Eiji Yanai, Iwaki; Tsuguo Hashimoto, Hitachi; Kiyoshi Takeuchi, Ibaraki; Takashi Asao; Yoshiki Noguchi, both of Hitachi, all of Japan

[73] Assignee: Hitachi, Ltd., Tokyo, Japan

[21] Appl. No.: 120,097

[22] Filed: Nov. 13, 1987

[30] Foreign Application Priority Data

Nov. 14, 1986 [JP] Japan ..... 61-269596

[51] Int. Cl.[4] ..... F01K 21/00

[52] U.S. Cl. ..... 60/657; 60/646

[58] Field of Search ..... 60/646, 657; 277/3, 277/15

[56] References Cited

U.S. PATENT DOCUMENTS

| | | | |
|---|---|---|---|
| 3,062,553 | 11/1962 | Juzi | 60/646 X |
| 3,906,730 | 9/1975 | Bellati et al. | 60/657 |
| 3,935,710 | 2/1976 | Dickinson | 60/657 |
| 4,517,804 | 5/1985 | Ura et al. | 60/657 |
| 4,589,256 | 5/1986 | Akiba et al. | 60/657 X |

*Primary Examiner*—Allen M. Ostrager

*Attorney, Agent, or Firm*—Antonelli, Terry & Wands

[57] ABSTRACT

In order to recover the heat of the waste gas from a gas turbine, a waste heat recovery boiler is provided, which has a high-pressure steam generating portion consisting of an economizer, a high-pressure steam generator and a superheater, and a low-pressure steam generating portion consisting of an economizer, and a low-pressure steam generator. The steam from the high-pressure generating portion is supplied to the turbine through a high-pressure steam pipe, and the steam from the low-pressure steam generating portion to the same through a low-pressure steam pipe. The high-pressure gland sealing steam is supplied to a high-pressure side steam gland portion the steam turbine through a high-pressure steam extracton pipe branching from the high-pressure steam pipe, a steam pressure regulator adapted to regulate the steam pressure and introduce the excess steam to a condenser, and a high-pressure gland sealing steam pipe. The low-pressure gland sealing steam is supplied to a low-pressure side steam gland portion through a low-pressure steam extraction pipe branching from the low-pressure steam pipe, a reducing valve adapted to supply steam of a constant pressure due to a depressurization operation, and a low-pressure gland sealing steam pipe.

7 Claims, 6 Drawing Sheets

GLAND SEALING STEAM SUPPLY SYSTEM FOR STEAM TURBINES

BACKGROUND OF THE INVENTION

This invention relates to a gland sealing steam supply system for steam turbines, and more particularly to a gland sealing steam supply system for steam turbines, which is suitably used for a steam turbine in a combined cycle plant.

In a steam turbine, the leakage of the turbine driving steam to the outside is prevented by supplying sealing steam to a gland portion of the turbine, or subjecting the leakage steam from the gland portion to heat recovery, to thereby improve the operation efficiency of the turbine. The supplying of steam to the gland portion or the recovering of the leakage steam therefrom is controlled by a steam pressure regulator provided so as to be connected to a high-pressure primary steam extraction pipe branching from a high-pressure primary steam pipe through which the turbine driving seam is supplied, a pipe for high-pressure gland sealing steam connected to a high-pressure gland portion of the turbine, and a pipe for low-pressure gland sealing steam connected to a low-pressure gland portion of the turbine. During an initial period of an operation of a steam turbine, steam tends to be supplied to the high-pressure gland portion, and, in the main portion of the operation of the turbine, the steam tends to leak from the turbine. The pressure of this leakage steam is regulated by the steam pressure regulator, and the resultant steam is supplied to the low-pressure gland portion through the pipe of low-pressure gland sealing steam. When the leakage steam from the high-pressure gland portion does not serve as sufficient low-pressure gland sealing steam, supplementary steam is used, which is introduced from the high-pressure primary steam pipe to the steam pressure regulator through the high-pressure primary steam extraction pipe. When the sealing steam in the low-pressure gland portion is more than enough, the excess steam is discarded into a condenser through an additionally provided exhaust pipe extending from the pressure regulator.

The typical examples of the steam conditions for various portions of the system will now be described with reference to a combined cycle plant taken as an example. The turbine-driving inflow steam is about 57(ata) and 480(° C.) during a rated operation, while the sealing steam supplied to the high-pressure gland portion by the pressure regulator is about 1.3(ata) and 450(° C.). The steam obtained by regulating the leakage steam from the high-pressure gland portion by the pressure regulator and sent out to the pipe for low-pressure gland sealing steam also has steam conditions substantially identical with those for the above mentioned sealing steam. The conditions for the steam supplied to the low-pressure gland portion are determined depending upon those for the turbine driving steam discharged from the turbine, and require to be 1.3(ata) and 110°–140 (° C.). As is clear from the above, the pressure only may be controlled suitably on the side of the high-pressure gland portion but it is necessary to further regulate the temperature on the side of the low-pressure gland portion. The steam supplied as the sealing steam for the low-pressure gland portion to the steam pressure regulator has a sufficiently high temperature, and introducing this steam as it is to the low-pressure gland portion causes a decrease in the material values, such as thermal stress and differential expansion of a turbine rotor, i.e., produces non-preferable results. Therefore, methods of reducing the temperature of such low-pressure gland sealing steam are employed, which are disclosed in Japanese Patent Laid-Open No. 14805/1981, and which include a method of cooling the pipe for the low-pressure gland sealing steam with a primary waste gas current from the turbine before the steam has been supplied to the low pressure gland portion, or a method of cooling such a pipe with condensate from a desuperheater provided for this purpose.

Although these methods are suitably used for a regular thermal power generating turbine plant, they are not for a turbine plant for a combined cycle plant. For example, in the former method of cooling the low-pressure gland sealing steam with a waste gas current from the turbine, the pipe for the low-pressure gland sealing steam is detoured to form a loop pipe in the position in which the loop pipe faces the primary waste gas current from a rotor blade in the steam turbine, so as to improve the cooling effect. The gland sealing steam cooled with the primary waste gas current is introduced into the low-pressure gland portion through the pipe for the low-pressure gland sealing steam. However, in this method, the loop pipe is provided in a flow passage for the primary waste gas current from the turbine for the purpose of improving the steam desuperheating effect, so that the operation efficiency necessarily decreases. Especially, in a compound generating plant consisting of a gas turbine and a steam turbine using the waste heat from the gas turbine as a heat source, the capacity of the steam turbine cycle is small. Consequently, it becomes difficult to secure a space for installing the loop pipe in the gas discharge portion of the steam turbine, and installing the loop 13 in this portion of the steam turbine causes the efficiency to further decrease. In the latter method of cooling the low-pressure gland sealing steam by using an additionally-provided desuperheater, the cooling of the sealing steam is done by a desuperheater provided additionally in an intermediate portion of a pipe for the low-pressure gland sealing steam.

The condensate in a gland steam condenser, which is connected to the discharge port of a condensing pump, is parted at an outlet of the condenser and supplied to a desuperheater through a desuperheated water supply pipe, this condensate being used as cooling water. The used cooling water is returned to the condenser through a desuperheated water returning pipe. In this method, the desuperheater is provided independently on the outer or inner side of the condenser. Therefore, it is necessary that a thorough consideration be given to the designing and manufacturing of the desuperheater as a pressure vessel. Moreover, securing a space for installing the desuperheater gives rise to some problems. Especially, in a compound generating plant consisting of a plurality of units, a plurality of desuperheaters and pipes are required, so that the manufacturing cost increases.

SUMMARY OF THE INVENTION

The present invention has been developed in view of these facts. It is an object of the present invention to provide a simply-constructed, inexpensive gland sealing steam supply system capable of supplying gland sealing steam with no possibility of occurrence of a decrease in the turbine efficiency.

The present invention can be applied to a turbine plant having turbine-driving high-pressure steam as well as a turbine plant having lower-pressure steam, and is provided with a means for depressurizing the low-pressure primary steam, and a pipe for use in supplying the low-pressure primary steam, which has been desuperheated during the depressurization thereof, to a low-pressure gland sealing portion.

The temperature and pressure of this low-pressure primary steam are not much higher than the levels which are proper as the levels of the temperature and pressure of the steam used as the low-pressure gland sealing steam. Accordingly, it is easy to depressurize the low-pressure primary steam to the level satisfying the conditions for the low-pressure gland sealing steam, and, moreover, the temperature of the steam drops as the steam is depressurized. For these reasons, the steam obtained by extracting the low-pressure primary steam and depressurizing the resultant steam becomes optimum as the low-pressure gland sealing steam.

DESCRIPTION OF THE PREFERRED EMBODIMENT

Before describing an embodiment of the present invention, the general construction of a combined cycle plant will be described as an example of a suitable plant in which the high-pressure steam and low-pressure steam can be obtained.

Figure 1:
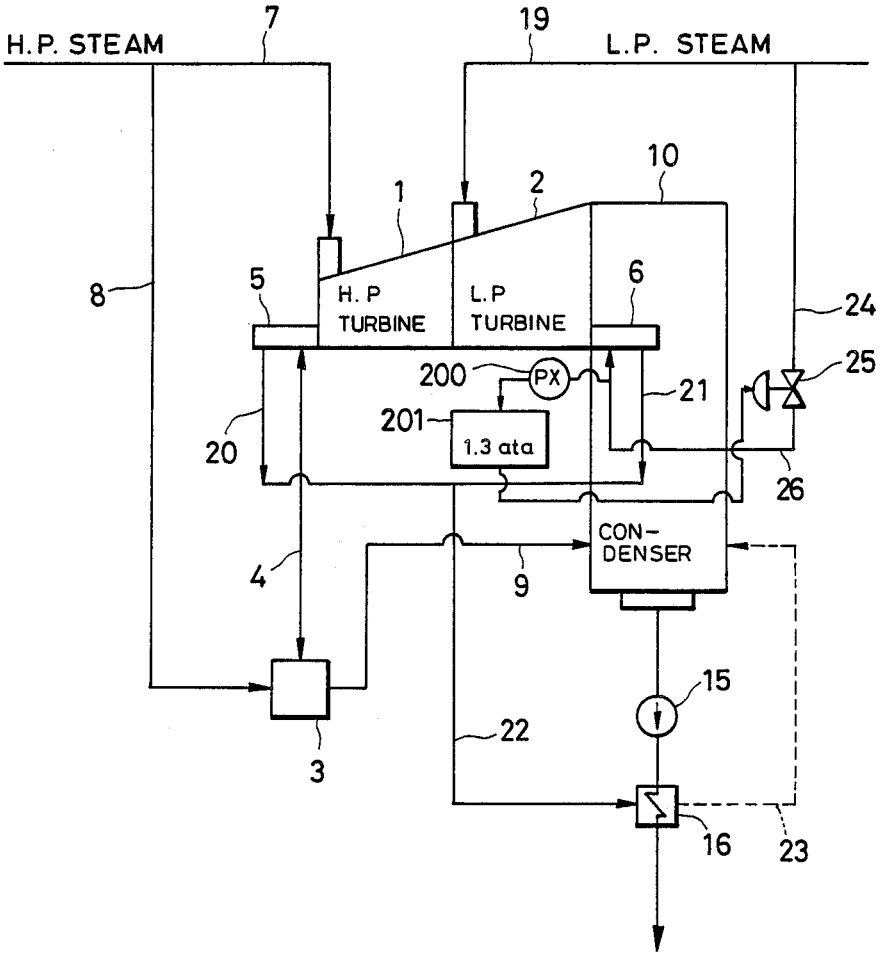
FIG. 1 shows an embodiment of the present invention in which the low-pressure primary steam is cooled through a reducing valve and used as the low-pressure gland sealing steam.
Figure 2:
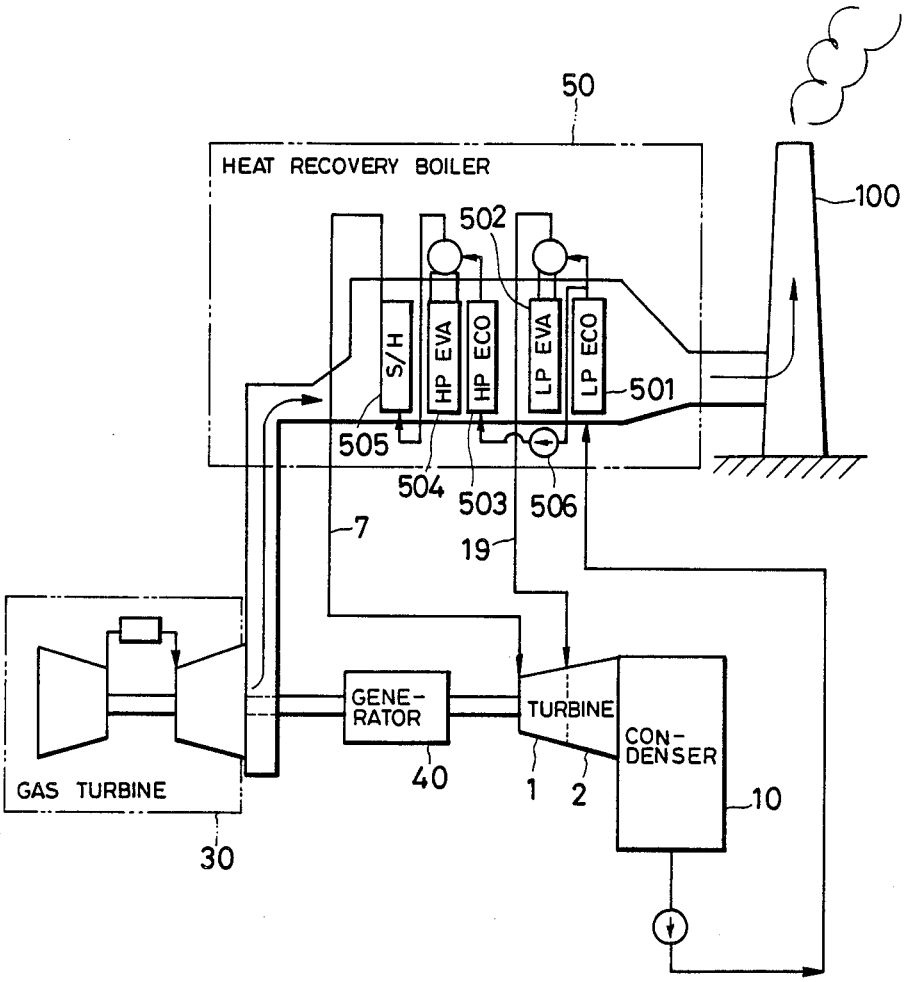
FIG. 2 is a schematic diagram of a combined cycle plan.

Referring to FIG. 2, reference numeral 30 denotes a gas turbine, a combustion waste gas from which still holds a considerable quantity of heat, which is recovered by a waste heat recovery boiler 50 and then discharged from a chimney 100. In this waste heat recovery boiler 50, the feed water from a condenser 10 is heated in a low-pressure economizer 501 and a low-pressure evaporator 502 to obtain low-pressure steam in a low-pressure steam pipe 19. The feed water heated in the low-pressure economizer 501 is sent to a high-pressure system by a pump 506. The high-pressure system consists of a high-pressure economizer 503, a high-pressure evaporator 504 and a high-pressure superheater 505, and high-pressure primary steam is obtained in a high-pressure primary steam pipe 7 The reason why two systems, i.e. high-pressure and low-pressure systems are provided resides in that, when the two systems are provided, the thermal efficiency becomes higher than when the high-pressure system alone is provided. This drawing shows an example of a mixed pressure turbine in which the high-pressure steam 7 and low-pressure steam 19 are used in one turbine. Reference numeral 11 denotes a high-pressure turbine, 2 a low-pressure turbine, and 40 a generator. FIG. 1 shows an embodiment of the present invention having a turbine, which utilizes high-pressure steam and low-pressure steam obtained as shown in FIG. 2, and a system extending around a condenser.

In a mixed pressure steam turbine plant shown in FIG. 1 and having high-temperature high-pressure primary steam and low-temperature low-pressure primary steam, the high-pressure primary steam flows into a high-pressure steam turbine 1 first, through a high-pressure primary steam pipe 7. This steam performs work sequentially as it flows toward a low-pressure steam turbine 2. The low-pressure primary steam flows from an inlet of the low-pressure steam turbine 2 thereinto through a low-pressure primary steam pipe 19, and is mixed with the high-pressure steam, the mixed steam performing further work. Finally, this steam turns into low-temperature low-pressure steam and is discarded into a condenser 10.

Consequently, the temperature at a high-pressure gland portion 5 becomes very high, and that at a low-pressure gland portion 6 comparatively low.

In order to obtain sealing steam which satisfies the conditions matching the temperatures of he metal at these gland portions 5, 6, high-pressure primary steam is supplied at the high-pressure side to the high-pressure gland portion 5 through a high-pressure primary steam extraction pipe 8, a steam pressure regulator 3 and a pipe 4 for the high-pressure gland sealing steam. The greater part of the sealing steam is introduced into a gland steam condenser 16 through gland steam leakage pipes 20, 22 in such a manner that the steam does not leak from the turbine plant to the outside. In this condenser 16, the gland leakage steam is subjected to heat recovery by the condensate pumped out from the condenser 10 by a condensate pump 15, to turn the steam into drainage, which is then recovered by the condenser 10 through a gland leakage drain pipe 23. The residual steam in the pressure regulator 3 is recovered by the condenser 10 through a discharge pipe 9 joined to the pressure regulator. This steam supply system is different from a conventional steam supply system of this kind in that the sealing steam supplying and leakage steam recovering systems for the high-pressure gland portion 5 are not adapted to send the steam which has been regulated by the pressure regulator 3 to the low-pressure gland portion 6.

The above is a description of the flow of the sealing and leakage steam at the high-pressure gland portion 5. At the low-pressure gland portion 6, the allowable level of temperature is extremely low as compared with that of temperature at the corresponding portion of the high-pressure steam turbine 1. Therefore, the low-pressure primary steam is extracted from a low-pressure primary steam pipe 19 by a low-pressure primary steam extraction pipe 24, and this steam is depressurized by a reducing valve 25 to a predetermined level, for example, 1.3 ata of the gland sealing steam to be supplied, the resultant steam being supplied to the low pressure gland portion 6 through a pipe 26 for the low-pressure gland steam. Although the temperature of the low-pressure primary steam is slightly higher than a limit level of the temperature of the gland sealing steam to be supplied, the steam depressurized by the reducing valve 25 to a predetermined level of the pressure of the gland sealing steam to be supplied is desuperheated due to an enthalpic change. Accordingly, the temperature of the steam at the gland portion 6 is controlled within the mentioned limit level. In case of the above-described combined cycle plant, the conditions for the low-pressure primary steam are around 6(ata) and 160(° C.). On the other hand, the range of temperature of the low-pressure sealing steam matching the temperature of the metal of the low-pressure gland portion which is heated with the waste gas flowing from the low-pressure turbine 2 to the condenser 10 is 110°-140(° C.). If tee pressure on the pipe 21 for the low-pressure gland sealing steam is detected by a pressure sensor 200 to control the degree of opening of the reducing valve 25 through a regulator 201 so that this pressure is set to a predetermined level (for example, 1.3 ata), the temperature of the sealing steam attains a level in a suitable range (110°-140° C.). Thus, the low-pressure gland sealing steam obtained by the reducing valve 25 is supplied at an optimum temperature to the low-pressure gland portion 6 through the pipe 26 for gland sealing steam.

The leakage steam which has been used for the gland sealing operation flows through the pipe 21 for gland leakage steam, and meets the steam in the pipe 20 for high-pressure gland leakage steam, the resultant steam being supplied to the steam condenser 16 through the gland leakage steam pipe 22. This steam is then subjected to heat recovery by the condensate pumped from the condenser 10 by the condensate pump 15, to turn into drainage, which is then recovered by the condenser 1 again.

As described above, the temperature of the low-pressure primary steam enters the permissible temperature range for the low-pressure gland portion 6 by depressurizing the low-pressure steam by the reducing valve. This will now be described in detail.

Figure 3:
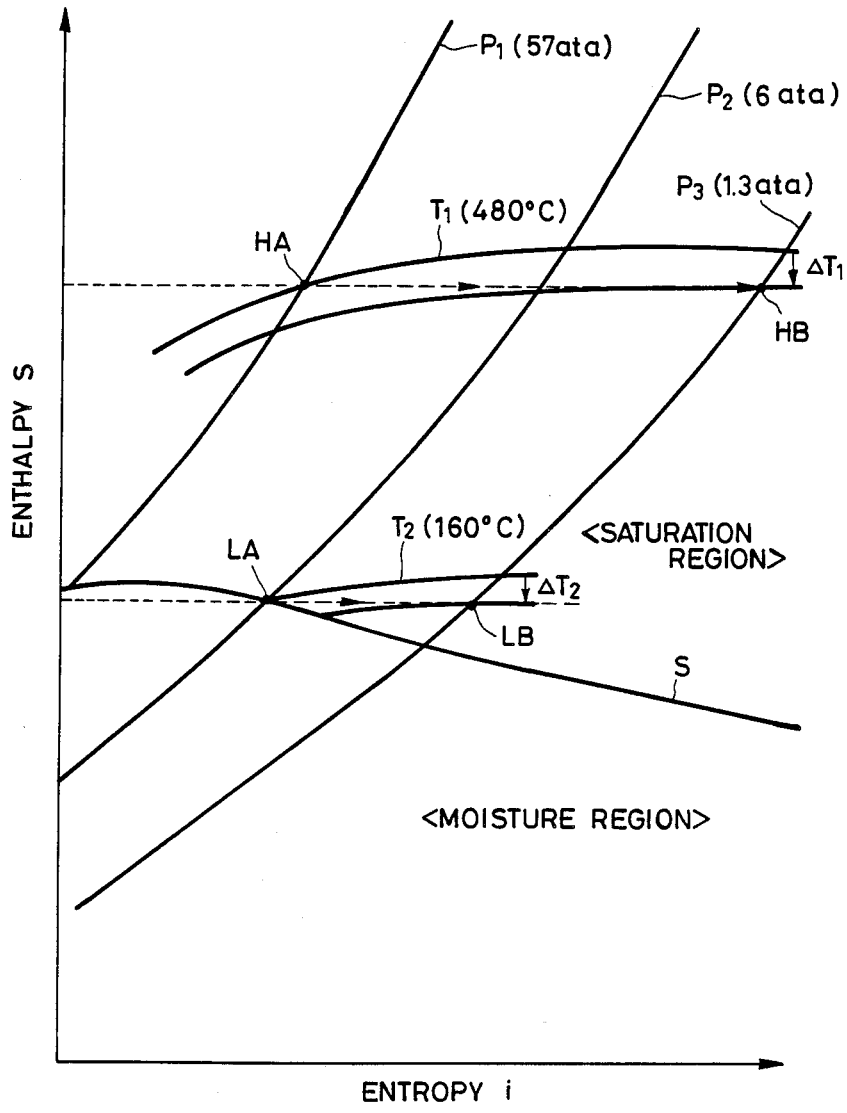
FIG. 3 is a graph for describing the desuperheating action based on the isoentropic effect.

FIG. 3 is a known steam chart in which the entropy i and enthalpy DK are taken in the directions of the lateral axis and longitudinal axis, respectively. Referring to this chart, reference letter SK indicates a saturation line, the region under this line being a moisture region, the region above the same line being a saturation region. Reference letters P, T indicate a line of constant pressure and a line of constant temperature, respectively, $P_1$, $P_2$, $P_3$ lines of constant pressures of 57 ata, 6 ata and 1.3 ata, respectively, and $T_1$, $T_2$ lines of constant temperatures of 480° C. and 160° C., respectively. Accordingly, the value of the steam conditions for the high-pressure primary steam is positioned on an intersection HA of $P_1$ and $T_1$ on this drawing, and the value of the steam conditions for the low-pressure primary steam, which consists of saturated steam, on an intersection LA of $P_2$ and $T_2$. In general, the steam has the characteristics (isoenthalpic change) that, when the steam is depressurized, the temperature alone thereof drops with the enthalpy kept constant. When the steam is depressurized by the pressure regulator 3 as shown in FIG. 2, the value of the conditions for the high-pressure primary steam is positioned on a point HB of 1.3 ata in FIG. 3 due to the isoenthalpic change, which point HB is determined by moving the point HA in parallel with the lateral axis of the chart, and the temperature lowers by $\Delta T_1$. The $\Delta T_1$ represents about 30° C.. Similarly, when the steam is depressurized by using the reducing valve 25, the steam conditions represented by the point LA are changed to those represented by the point LB, and a temperature drop $\Delta T_2$ occurs. The $\Delta T_2$ represents about 20° C., and sealing steam of about 140° C. is obtained.

Figure 4:
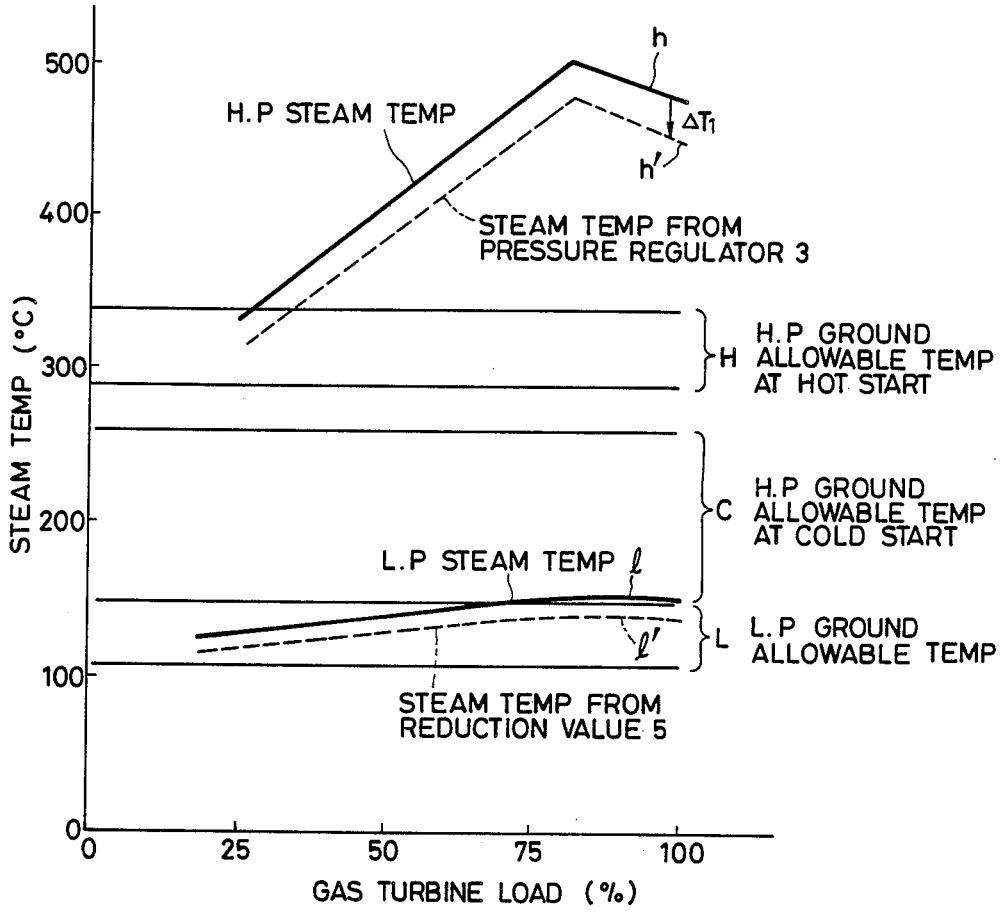
FIG. 4 is a graph showing the temperatures of the high-pressure primary steam and low-pressure primary steam with respect to a gas turbine load, and the temperature characteristics of the steam determined after the steam has been depressurized and the gas turbine load.

The above statement with reference to FIG. 3 indicates that the conditions for the steam during a rated operation are reduced due to an isoenthalpic change. The practical steam temperature varies depending upon the magnitude of a load, so that the temperature of the sealing steam also varies accordingly. FIG. 4 is a characteristic diagram showing variations of the high-pressure primary steam and low-pressure primary steam with respect to a gas turbine load (taken in the direction of the lateral axis). As the gas turbine load decreases from 100% to about 80%, the temperature of the waste gas temporarily increases due to the operation control characteristics of the gas turbine, so that the temperature h of the high-pressure primary steam increases in accordance with the increase of the temperature of the waste gas. When the gas turbine load is in the range of not more than 80%, the temperature h of the high-pressure primary steam gradually decreases as the gas turbine load decreases. The variations of the temperature l of the low-pressure primary steam with respect to the gas turbine load are very small, and extremely stable as compared with the variations of the temperature of the high-pressure primary steam.

The characteristics of the temperature obtained by depressurizing the high-pressure primary steam, which is used as the supply source of the high-pressure gland sealing steam, to a predetermined pressure (1.3 ata) of the sealing steam to be supplied are shown by h'. This temperature is a temperature, which matches the gas turbine load, of the sealing steam to be supplied. However, as mentioned above, since the steam in the turbine tends to leak from the high-pressure gland portion during an operation of the turbine plant, the characteristics of the temperature at the gland portion 5 are slightly different from those shown by h'. The difference between the characteristics h, h' in this drawing corresponds to $\Delta T_1$ in FIG. 3. The characteristics h, h' in FIG. 4 show the relation between the temperature and turbine load during an operation of the turbine plant with a predetermined load. The relation between the temperature of the high-pressure primary steam and that of the gland sealing steam in a starting stage in which the conditions for the high-pressure steam are not established cannot be explained with reference to the characteristics h, h'. However, in a hot starting mode, the steam in the temperature region (about 290°-340° C.) of H in the drawing must be supplied to the high-pressure gland portion 5, and, in a cold starting mode, the steam in the temperature region (about 150°-260° C.) of C in the drawing must be supplied thereto.

The temperature characteristics of the steam (i.e. the steam obtained by depressurizing the low-pressure primary steam to a predetermined pressure by a reducing valve) to be supplied for sealing the low-pressure gland portion are shown by l'. The temperatures shown by this characteristic curve are within tee range L (about 110°-140° C.) of permissible temperature at the low-pressure gland portion 6 in all regions of gas turbine load. Moreover, since the width of variations of the steam temperature is small and stable, sudden thermal stress does not occur in the low-pressure gland portion 6. The range L of permissible temperature at the low-pressure gland portion 6 does not vary in the starting mode unlike the ranges H, C of permissible temperature at the high-pressure gland portion 5. The temperature at the low-pressure gland portion 6 may always be controlled to be in this range through-out the starting stage.

FIG. 4 shows that the temperature at the low-pressure gland portion 6 can be controlled to be in the range L of permissible temperature in all regions of turbine load during an operation of the turbine plant. Since the lower limit level of permissible temperature in a starting stage is as low as 110° C., the time during which the temperature of the low-pressure primary steam has risen to this level to enable the steam to be utilized as low-pressure gland sealing steam is extremely short, so that the sealing steam can be secured in an initial stage of a starting operation.

The high-pressure primary steam consists of superheated steam, while the low-pressure primary steam consists of saturated steam which turns into drainage when it is desuperheated. The entry of no drainage is allowed at the gland portion of the turbine. Someone may wonder if these facts constitute the drawbacks of the system according to the present invention but there is nothing to fear. The reason is that, while the steam is depressurized by the reducing valve to a pressure at which the steam is supplied to the gland portion of the turbine, the steam enters a superheating region due to the characteristics thereof and an isoenthalpic change shown in FIG. 3 (but the temperature thereof decreases). Therefore, the steam comes to have opposite characteristics, i.e., becomes difficult to turn into drainage.

Thus, the gland sealing steam supply system according to the present invention can be practiced without any troubles. Especially, it is possible that the lifetime and reliability of the gland sealing portion of the low-pressure turbine be improved greatly owing to the thermal stress-lessening techniques.

The above are the descriptions of the problems concerning the sealing of and the leakage of steam from the gland sealing portion of the turbine mainly in normal operation. Problems at the time of starting of the turbine plant will now be described with reference to FIG. 5. FIG. 6 shows the parallel arrangement of a plurality of units of compound generating plants, each of which consists of the compound generating plant of FIG. 2.

The problems at the time of starting of the turbine plant are:

(1) The gland sealing portion of the steam turbine is in a cooled state as compared with the gland seal portion during a norma operation of the turbine plant.

(2) Since the gas turbine is left stopped, the conditions for the primary steam, a gland sealing steam supply source, portion, are unsatisfactory (as compared with those while the operation of the turbine plant continues).

The problem of the cold gland sealing portion is as follows.

In general, typical starting modes include a hot starting mode (in which the turbine unit is started after it has been stopped for eight hours), a warm starting mode (in which the turbine unit is started after it has been stopped for thirty-two hours) and a cold starting mode (in which the turbine unit is started after it has been stopped for not less than one week), which are called differently depending upon the hours during which the turbine unit has been stopped. The turbine and the gland sealing portion tend to be cooled more in tee warm starting mode than in the hot starting mode, and still more in the cold starting mode than in the warm starting mode. An example of the turbine plant operated in the hot and cold starting modes will now be described with reference to FIGS. 4 and 5.

Referring to FIG. 4, reference letter H represents the tolerance of the temperature of the steam to be supplied to the gland sealing portion of the high-pressure pressure steam turbine in a hot starting mode, and C the tolerance of such a temperature in a cold starting mode.

The permissible temperature of the steam to be supplied to the gland sealing portion of the low-pressure steam turbine is in a predetermined range designated by L, and low in any cases irrespective of the operating mode of the gas turbine.

The supplying of steam to the gland sealing portion of the high-pressure steam turbine is done in the same manner as in a prior art turbine plant of this kind, and a description thereof will be omitted.

As described above, concerning the problem (1), the sealing steam for the gland portion of the low-pressure steam turbine in the present invention keeps a permissible temperature satisfactorily in all load regions of the gas turbine, and it is not necessary at all to give consideration to the temperature variations with respect to the starting mode thereof.

Figure 5:
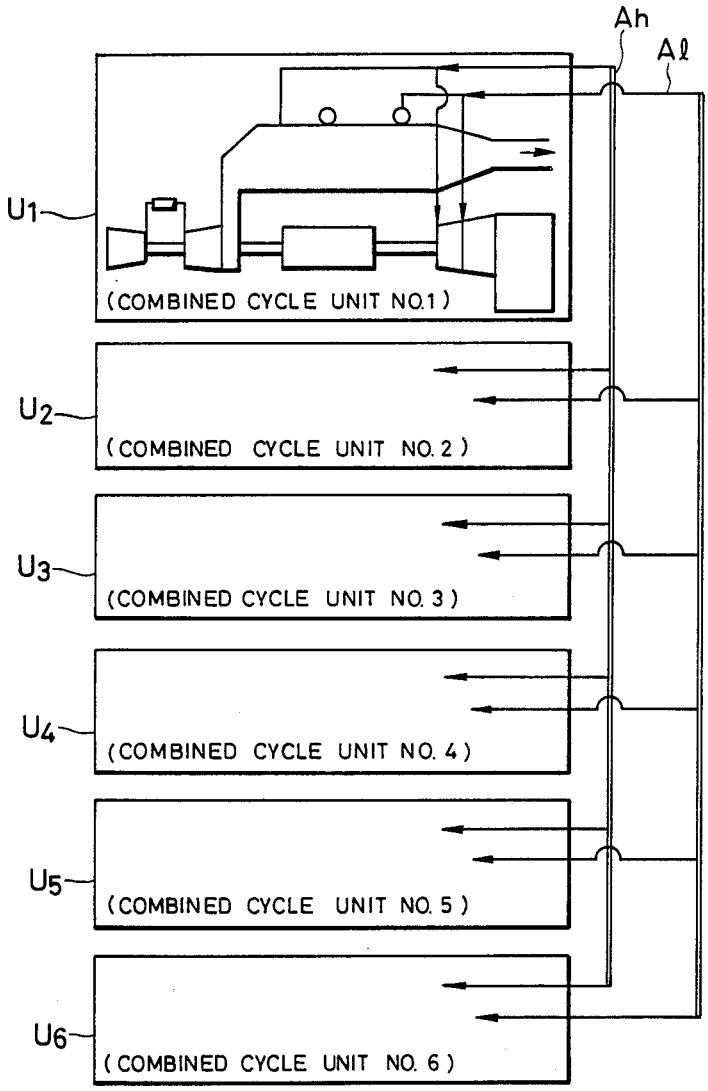
FIG. 5 shows the construction of a plant in which a plurality of combined cycle plants are provided in parallel with one another to supply steam mutually.
Figure 6:
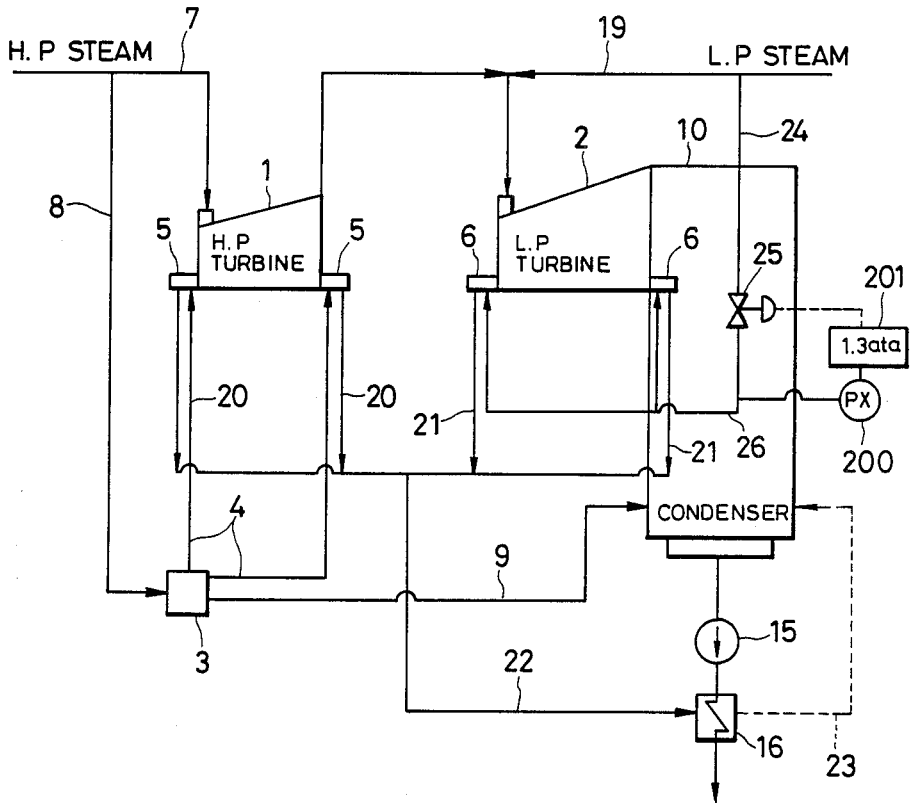
FIG. 6 shows the construction of another type of combined cycle plant.

Concerning the above problem (2) that the conditions for the primary steam are unsatisfactory, each primary steam, a gland sealing steam supply source does not satisfy even the conditions shown in FIG. 5 as mentioned previously at the gas turbine starting time. In order to prevent this inconvenience, the high-pressure primary steam pipes may be joined together by a common make-up high-pressure steam pipe Ah, and a common make-up low-pressure steam pipe for the gland leakage low-pressure primary steam may be provided so as to join together the steam in each unit, the common low-pressure steam pipe being connected to the low-pressure primary steam pipes L.

These steam pipes are used under less severe conditions including very low temperature and pressure than the high-pressure steam pipes, so that they give rise to no problems in the designing and manufacturing thereof.

Finally, it can be said that the operation efficiency of the turbine plant employing the present invention, in which the easily-obtainable low-quality steam is utilized, tends to be rather improved as compared with that of a conventional turbine plant in which the high-pressure primary steam is desuperheated and then put to use.

In the above statement, a combined cycle plant is taken as an example of a plant provided also with low-pressure steam, and the conditions for the high-pressure steam and low-pressure steam are limited to typical examples. A plant to which the present invention is applied may have any construction as long as it is capable of supplying low-pressure steam, and such a plant having suitable steam conditions can attain the effect of the present invention. In the above statement, a mixed pressure turbine is taken as an example. A turbine of an arbitrary type can, of course, be employed. For example, the turbine plant shown in FIG. 6 is of the type in which the high-pressure turbine 1 and low-pressure turbine 2 are separated from each other. In this turbine plant, the gland portion 5 of the high-pressure turbine 1 is joined to the pressure regulator 3, and steam is supplied from the reducing valve 25 to the gland portion 6 of the low-pressure turbine 2.

According to the present invention, the omitting of the desuperheater for the gland sealing steam for the low-pressure steam turbine enables the turbine plant to be simplified effectively and the cost price thereof to be reduced greatly.

A comparison between the present invention and the conventional techniques, in which the pipe for the low-pressure gland sealing steam is extended into the interior of the condenser to cool the steam with the waste gas from the turbine, shows that the former will render it possible to improve the efficiency of the steam turbine owing to the omission of a loop pipe which causes the resistance in the waste gas flow passage to increase.

The present invention does not require the cooling water for a desuperheater as compared with the prior art turbine plant in which a desuperheater is provided. This enables the pump capacity and pump input power to be reduced.

The steam supply system according to the present invention has a high reliability. Namely, it is capable of supplying seal steam of optimum conditions effectively to the gland seal portion of the low-pressure steam turbine without carrying out complicated operations. Therefore, the present invention can provide a non-lifetime-decreasing steam turbine system.

What is claimed is:

1. A gland sealing steam supply system for a steam turbine, comprising means for supplying steam to a low pressure gland portion of the steam turbine independently of steam supplied to a high pressure gland portion of the steam turbine, and reducing valve means for depressurizing the steam supplied to said low pressure gland portion.

2. A gland sealing steam supply system according to claim 1, wherein said steam turbine consists of a mixed pressure turbine in which steam of a plurality of pressures is used as the driving steam.

3. A gland sealing steam supply system according to claim 1 or 2, wherein a waste heat recovery boiler is provided to obtain the driving steam for said steam turbine.

4. A gland sealing steam supply system according to claim 3, wherein said waste heat recovery boiler for supplying steam for driving said steam turbine has a high-pressure steam generating portion and a low-pressure steam generating portion.

5. A gland sealing steam supply system according to claim 4, whereina plurality of combined units of said steam turbine and said waste heat recovery boiler are provided, and a makeup communication pipe is provided between said high pressure steam generating portion and said low pressure steam generating portion of said waste heat recovery boiler of each of said units.

6. A gland sealing steam supply system for steam turbines, adapted to supply steam to a gland portion of a steam turbine which is driven by high-pressure steam and low-pressure steam introduced thereinto, comprising a high-pressure steam pipe for use in supplying high-pressure steam to said turbine, a high-pressure steam extraction pipe branching from said high-pressure steam pipe, a high-pressure gland sealing steam pipe connected at its one end to a high-pressure side steam gland portion of said steam turbine, a steam pressure regulator provided between the other end of said high-pressure gland sealing steam pipe and said high-pressure steam extraction pipe and adapted to regulate a steam pressure and introduce excess steam to a condenser, a low-pressure steam pipe for use in supplying low-pressure steam to said turbine, a low-pressure gland sealing steam pipe connected at its one end to a low-pressure side steam gland portion of said steam turbine, and a reducing valve provided between the other end of said low-pressure gland sealing steam pipe and said low-pressure steam extraction pipe and adapted to supply steam of a constant pressure.

7. A gland sealing steam supply system according to claim 6, wherein said system further includes a gas turbine, and a waste heat recovey boiler used for recovering heat of a waste gas from said gas turbine and having a high-pressure steam generating portion consisting of an economizer, a high-pressure steam generator and a superheater, and a low-pressure steam generating portion consisting of an economizer, and a low-pressure steam generator, the steam from said high-pressure steam generating portion being supplied to said turbine through said high-pressure steam pipe, the steam from said low-pressure steam generating portion being supplied to said turbine through said low-pressure steam pipe.

* * * * *